US010401897B2

(12) United States Patent
Schweer et al.

(10) Patent No.: US 10,401,897 B2
(45) Date of Patent: Sep. 3, 2019

(54) BRAKING-STOPPING UNIT FOR COMMAND ISSUER

(71) Applicant: Aventics GmbH, Laatzen (DE)

(72) Inventors: Karl-Heinz Schweer, Wennigsen (DE); Anja Quast, Langenhagen (DE)

(73) Assignee: Aventics GmbH, Laatzen (DE)

( * ) Notice: Subject to any disclaimer, the term of this patent is extended or adjusted under 35 U.S.C. 154(b) by 140 days.

(21) Appl. No.: 15/543,412

(22) PCT Filed: Jan. 15, 2016

(86) PCT No.: PCT/DE2016/000015

§ 371 (c)(1),
(2) Date: Jul. 13, 2017

(87) PCT Pub. No.: WO2016/112893

PCT Pub. Date: Jul. 21, 2016

(65) Prior Publication Data

US 2018/0329446 A1 Nov. 15, 2018

(30) Foreign Application Priority Data

Jan. 15, 2015 (DE) ..... 10 2015 000 192

(51) Int. Cl.
*G05G 9/08* (2006.01)
*B63H 21/21* (2006.01)

(52) U.S. Cl.
CPC ..... *G05G 9/08* (2013.01); *B63H 21/213* (2013.01)

(58) Field of Classification Search
CPC ..... G05G 9/08; B63H 21/213
See application file for complete search history.

(56) References Cited

U.S. PATENT DOCUMENTS 4,646,588 A 3/1987 Winter
4,905,537 A 3/1990 Nagano
2008/0164361 A1* 7/2008 Fancher ..... B65H 75/4442 242/381

FOREIGN PATENT DOCUMENTS

DE 1 992 922 8/1968
DE 244 533 A1 4/1987
(Continued)

OTHER PUBLICATIONS

International Search Report corresponding to PCT Application No. PCT/DE2016/000015, dated Jun. 3, 2016 (German and English language document) (7 pages).

*Primary Examiner* — Stephen P Avila
(74) *Attorney, Agent, or Firm* — Maginot Moore & Beck LLP

(57) ABSTRACT

A braking-stopping unit for the defined stopping and braking of a manually operable command issuer for ship's drives includes an external rotor with a circular opening forming a bearing ring and an inner rotor arranged in the opening, which are arranged in a rotationally movable manner relative to each other. One of the two rotor elements is statically fixed in its position and the other rotor element is designed either with a manually operable actuator or constructed so as to be connectable to such an actuator. The inner rotor includes at least three spring arms which are radially arranged in the circumferential direction, wherein said spring arms can be pushed into a respective recess arranged in the outer surface of the inner rotor. The spring arms act in each case radially non-positively on the running surface of the bearing ring via the braking and stopping means.

9 Claims, 5 Drawing Sheets

(56) References Cited

FOREIGN PATENT DOCUMENTS

| | | | |
|---|---|---|---|
| DE | 199 36 946 | C1 | 1/2001 |
| DE | 199 63 476 | A1 | 7/2001 |
| DE | 203 05 291 | U1 | 7/2003 |
| DE | 103 52 445 | A1 | 10/2004 |
| FR | 0 359 979 | A2 | 2/1978 |
| JP | 2009-286165 | A | 12/2009 |

* cited by examiner

BRAKING-STOPPING UNIT FOR COMMAND ISSUER

This application is a 35 U.S.C. § 371 National Stage Application of PCT/DE2016/000015, filed on Jan. 15, 2016, which claims the benefit of priority to Serial No. DE 10 2015 000 192.2, filed on Jan. 15, 2015 in Germany, the disclosures of which are incorporated herein by reference in their entirety.

The disclosure relates to a unit for the defined latching and braking of a manually operable command issuer for speed and gear adjustment of ship propulsion systems.

BACKGROUND

The field of use of the present disclosure extends to ship control technology. The control stand of ships is conventionally equipped with a command issuer for remote control of the ship propulsion system. Nowadays, the command issuer here generally acts as an actuating element directly controlling the speed and/or gear adjustment of the ship propulsion system via an electrical connection to an electrical motor control of the ship propulsion system. To protect against unwanted adjustment caused by vibration or slight contact, such manually mechanically adjustable command issuers have to be guided in a sufficiently stable manner in order to reliably remain in the respective selected position. At the same time, however, they should be sensitive and capable of adjustment between the shift positions without a marked breakaway moment. For precise control, it is furthermore necessary for the actuating element to latch in a clearly perceptible manner in the shift positions of the actuating path. Typical shift positions in propulsion systems having reversing gears are, for example, the neutral gear-forward gear-reverse gear positions and, in propulsion systems having adjusting propellers, the neutral propeller position.

In command issuers which are generally known in the prior art, the latching function is frequently realized via spring-loaded balls or rollers which releasably engage in a corresponding counter-bore or -groove. Band brakes, which act on a shaft, or axially acting braking elements which act in a spring-loaded manner on a disk, are used for example for the braking function. These solutions are disadvantageous in that a plurality of components is required, which have to be set precisely and have to move with respect to one another with as little backlash as possible. A latching ball, which does not engage precisely in the ball socket, or a brake with backlash on reversal cause a spongy actuation and give the impression of a lack of precision. Each of these components is moreover subject to wear, which is why it is desirable to implement the different functions with as few components as possible. Finally, the assembly of many small individual parts is uneconomical.

DD 244533 A1 discloses a command issuer for ship propulsion systems having a lever, a shift disk and a latching disk driven by a first hydraulic actuator, which are fastened to a rotatably mounted shaft. A latching pin, which is actuated via a further hydraulic actuator, engages in the latching disk. A brake which acts on the edge of the latching disk and is actuated by a third actuator is furthermore provided. Owing to the hydraulic actuators required, the latching and braking function proposed by DD 244533 A1 is complex, expensive to produce and has a high spatial requirement.

DE 19936946 C1 discloses a command issuer for ship propulsion systems having a hand lever which is guided in a shifting gate and may be pivoted in two functional planes. To latch the shift lever in its shift positions, DE 19935946 C1 discloses a disk which is connected to a pivot shaft and has circumferential latching recesses in which a spring mounted latching pin engages. To automatically restore the hand lever to its idle position, it is acted upon by a tension-spring. The restoring and latching functions realized in addition to the mounting of the hand lever and independently of this each require additional components and have an additional spatial requirement. As a result of the tension spring acting thereon, the pivotal movement of the hand lever is only braked in a movement direction against the spring force. Other means for the stabilizing braking of the pivotal movements of the hand lever are not disclosed in DE 19936946 C1.

DE 199 63 476 A1 discloses a command issuer of the above-mentioned type, which is additionally mounted to be rotatable about its longitudinal axis in both directions of rotation against a spring action and which has a sensor detecting the rotational movement for controlling a unit, for example a motor control. The spring damping of the rotational movement, which is realized in addition to the mounting of the hand lever and independently of this, requires additional components and has an additional spatial requirement.

DE 1 992 922 U discloses a latching device for an engine telegraph in which a command lever having a latching roller is displaceably guided on a latching path. Depending on the selected height of the latching projections in relation to the latching recesses, such a device has either a relatively high breakaway moment or a relatively unstable position in the respective shift position. It is furthermore advantageous to design the command issuer to be pivotable on a circular path instead of linearly displaceably since this is more space-saving and enables more ergonomic operation whilst providing an equally long shift travel.

DE 103 52 445 B4 discloses a braking element for the controlled opening and closing of hoods, compartments, drawers etc. The braking element comprises an outer rotor having an opening forming a bearing shell and an inner rotor arranged in the opening, which are arranged to be rotationally movable relative to one another, wherein the inner rotor has one or more braking members which may be set radially against a spring force, are connected at one end to said inner rotor, may each be pressed into a recess incorporated in the lateral surface of the inner rotor and abut against the inner surface of the bearing shell. Owing to its spatial dimensions, the braking element (so-called mini braking element) disclosed in DE 103 52 445 B4 is not suitable for use as a command issuer and nor does it provide a manually operable actuating element, for instance an actuating lever, or means for assembling such an actuating element. Moreover, as a result of the identical alignment of the braking member(s) within the rotational plane, the braking element only executes a braking function in one direction—against the setting moment of the braking members—or the braking function in the opposite direction is in any case considerably reduced. Finally, the braking element proposed by DE 103 52 445 B4 does not provide any means for latching the inner rotor against the outer rotor.

SUMMARY

The disclosure is based on the object of providing a bearing unit for a manually operable command issuer having an integrated combined braking/latching function, which is constructed as compactly and simply as possible and can be manufactured and assembled simply and economically.

The object is achieved according to the disclosure by a braking/latching unit according to claim 1. Advantageous embodiments are described in the subclaims.

The core of the disclosure forms a braking/latching unit for command issuers having an outer rotor having a circular opening forming a bearing ring and an inner rotor arranged in the opening, which are arranged to be rotationally movable relative to one another, wherein one of the two rotor elements is statically fixed in its position and the other rotor element is either formed with a manually operable actuating element or is designed to be connectable to such and the inner rotor is formed with at least three spring arms which are arranged radially in the circumferential direction, are connected at one side to said inner rotor and may each be pressed into a recess located in the lateral surface of the inner rotor, wherein at least one spring arm is formed with a latching means at its free end, which cooperates with releasable form and force locking with at least one corresponding latching recess in the running surface of the bearing ring and at least two spring arms are arranged in each case in pairs within the rotational plane to work in opposite directions to each other and are each formed with a braking means at their free ends, and wherein the spring arms each act with radial force locking on the running surface of the bearing ring via the braking and latching means. The rotor element which is statically fixed in its position in each case serves as a stator (inner or outer stator) which is fixed in its position in that it is assembled for example at or on a console or an elevated housing. The other rotor element (inner or outer rotor) in each case, which is rotationally movable therein, serves to change the shift position in that it is either formed with a manually operable actuating element, for example an actuating lever, or is designed to be connectable to such in that it has bores, for example, for screwing-on an actuating lever. The spring arms having braking means, which are arranged in the circumferential direction, each exert different friction moments on the running surface depending on the direction of rotation. This is greater in the direction of rotation against the setting moment of the respective spring arm than it is in the opposite direction. As a result of the spring arms having braking means being arranged in the rotational plane in each case in pairs to work in opposite directions to each other, the two friction moments exerted thereby each add up to an identical total driving moment, whereby the braking/latching unit is braked in a substantially uniformly stabilizing manner in both directions of rotation. The latching recess(es) in the running surface of the bearing ring each represent the shift position(s) of the braking/latching unit. As a result of the spring arm(s) having latching means each engaging with form locking in the corresponding latching recess in the running surface of the bearing ring in the shift position, the braking/latching unit is stabilized in the respective position. Upon a new adjustment, the respective spring arm(s) having latching means is or are pressed into the respective recess in the lateral surface of the inner rotor, wherein the latching means exits the respective latching recess again.

An even greater uniformity of the braking actions exerted in both directions of rotation is achieved in that, in a braking/latching unit having a total of at least four spring arms, at least two spring arms are provided with latching means and are arranged in each case in pairs within the rotational plane to work in opposite directions to each other, wherein the latching means are arranged in a common radial portion and cooperate synchronously with the latching recess(es) in each case. The spring arms having latching means also act with radial force locking on the running surface of the bearing ring and therefore exert a certain friction moment against the rotation of the braking/latching unit. This is greater in the direction of rotation against the setting moment of the respective spring arm than it is in the opposite direction. As a result of the spring arms having latching means being arranged within the rotational plane in each case in pairs to work in opposite directions to each other, the total driving moment exerted via the latching means is also the same in both directions of rotation.

As a result of the latching means of a respective spring-arm pair being arranged in a common radial portion and cooperating in each case synchronously with the same latching recess in the above embodiment, an identical breakaway moment is ensured simultaneously in both directions of rotation when the latching action is released, without an additional second latching recess for the second latching means having to be provided in the running surface of the bearing ring for each spring-arm pair. To this end, the latching means of a spring-arm pair are arranged within the same radial portion, preferably adjacent to one another in the circumferential direction. This ensures a compact construction whilst maintaining a uniform breakaway moment in both directions.

For more precise adjustability of the braking/latching forces and to increase the field of use of the braking/latching unit, the spring arms having braking means and/or the spring arms having latching means are designed to be pressure-spring-loaded, wherein the pressure springs are arranged in the inner rotor and act radially on the spring arms. In this embodiment, the radial force required for the desired friction moment of the braking means and the sufficiently stable fit of the latching means is generated substantially by the pre-tension of the pressure springs. Depending on their design, with a correspondingly predetermined pre-tension and spring force, pressure springs can be constructed with a very much lower spring rate than is possible for spring arms formed merely as leaf springs. Therefore, the spring force and consequently also the radial force exerted thereby on the braking and latching means can be designed to always be virtually constant, even with different component tolerances. Furthermore, the radial forces required for the desired friction moment and the desired stability of the fit of the latching means in the latching recesses can be varied—independently of one another—and adapted to different requirements.

For particularly simple and economical manufacture and assembly of the braking/latching unit, the spring arms, latching means and braking means are constructed with the inner rotor as a single-part component. In this design, with all the required functional elements, the braking/latching unit consists of merely two components.

As a result of the above embodiment of the inner and outer rotor being constructed from plastics injection-molded parts, the manufacture can be further simplified and costs further reduced. Furthermore, this embodiment ensures a very low total weight of the device.

An improvement in the smooth-running of the braking/latching unit is achieved in that the rotor elements are constructed with a common ball bearing.

To improve operation, the rotor elements are formed with a stop delimitation which limits the rotational degree of freedom of movement. The extent of the shift travel of the braking/latching unit is thus limited to the shift positions.

To automatically detect the actuating position of the braking/latching unit, the rotationally movable rotor element is formed with a sensor magnet. This enables contactless detection of the angular position of the rotationally movable rotor element, and therefore also an actuating element connected thereto, for example in cooperation with a corresponding Hall sensor.

BRIEF DESCRIPTION OF THE DRAWINGS

Further measures for improving the disclosure together with the description of preferred exemplary embodiments of the disclosure are illustrated in more detail below with reference to the figures, which show.

DETAILED DESCRIPTION

Figure 1:
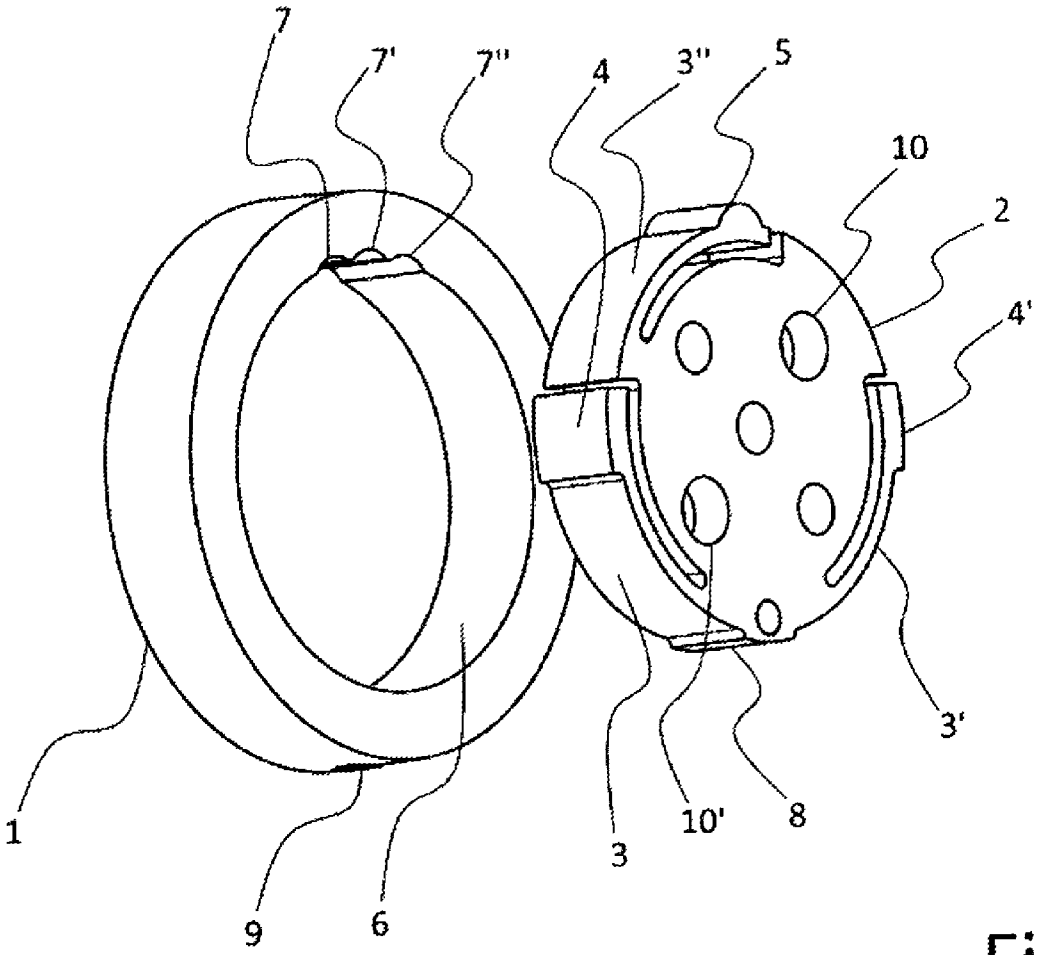
FIG. 1 a perspective exploded view of braking/latching unit for a command issuer.
Figure 2:
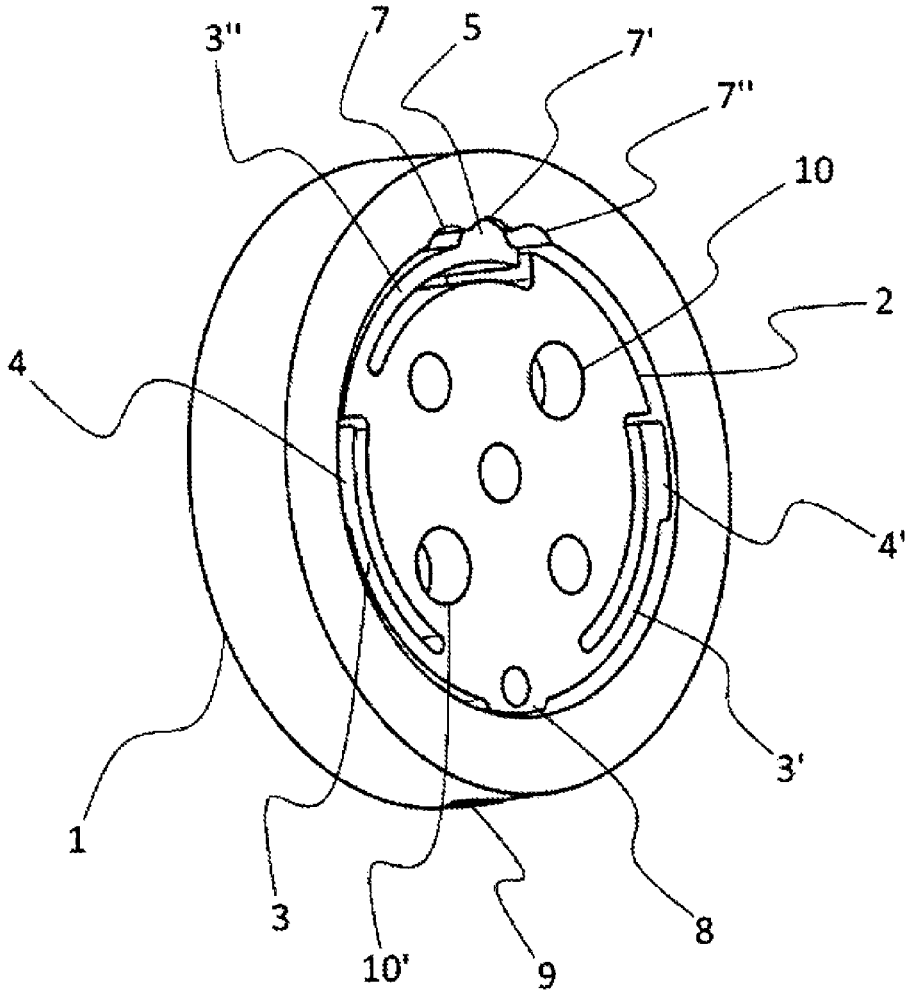
FIG. 2 a perspective front view of the braking/latching unit according to FIG. 1 in the assembled state.

The braking/latching unit according to FIGS. 1 and 2 comprises an outer rotor 1 and an inner rotor 2, which is formed with three spring arms 3, 3' and 3" designed as leaf springs, which are arranged radially in the circumferential direction and are fixedly connected at one side to said inner rotor. Below the spring arms 3, 3' and 3" in each case, corresponding recesses into which the spring arms 3, 3' and 3" may be pressed are located in the lateral surface of the inner rotor 2. The spring arms 3 and 3' are formed with the braking means 4 and 4' at their free end; the spring arm 3" is formed with the latching means 5. The spring arms 3, 3', 3" the braking means 4, 4' and the latching means are constructed with the inner rotor 2 as a single-part component. The outer rotor 1 has a circular opening which forms a bearing ring with the running surface 6 for receiving the inner rotor 2. The outer rotor 1 is formed with three latching recesses 7, 7' and 7" which serve for receiving the latching means 5 with form locking and determine the corresponding shift positions of the braking/latching unit. For assembly, the spring arms 3, 3', 3" are pressed into the respective corresponding recesses in the lateral surface of the inner rotor 2 and the inner rotor 2 is inserted into the outer rotor 1. Owing to the pre-tension generated thereby, the spring arms 3', 3' 3" in the assembled state according to FIG. 2 act with radial force locking on the running surface 6 of the outer rotor 1. A friction moment is thereby generated, in particular via the braking means 4 and 4', which counteracts a rotational movement of the inner rotor 2 against the outer rotor 1. The pre-tension of the spring arms 3, 3' is selected here such that they generate the radial force required for the desired friction moment. The two spring arms 3 and 3' arranged in the circumferential direction exert different friction moments on the running surface 6 via the braking means 4 and 4' depending on the direction of rotation. This is greater in the direction of rotation against the setting moment of the respective spring arm than it is in the opposite direction. As a result of the two spring arms 3 and 3' being arranged in the rotational plane to work in opposite directions to each other, the two friction moments exerted thereby each add up to an identical total driving moment, whereby the braking/latching unit is braked in a substantially uniformly stabilizing manner in both directions of rotation. The pre-tension of the spring arm 3" is selected such that a sufficiently stable form- and force-locking fit of the latching means 5 in the latching recesses 7, 7' and 7" is ensured in the shift positions whilst, at the same time, a breakaway moment upon their release is as low as possible. The pre-tension is selected such that an unwanted adjustment caused by vibrations during vehicle operation or a slight contact is sufficiently reliably avoided, whilst at the same time enabling a sensitive adjustment without requiring too great a force. As a result of the additional guide means 8, a rotationally symmetrical fit of the inner rotor 2 in the outer rotor is ensured. In the braking/latching unit according to FIGS. 1 and 2, the outer rotor 1 serves as a stator in that it may be connected to a housing via the radially arranged threaded bore 9 and is therefore statically fixed in its position in the installed state. The inner rotor 2 is arranged to be rotationally movable in the outer rotor 2 in the installed state and serves for manually changing the shift position by means of an actuating lever which may be screwed to the inner rotor 2 via the end-face bores 10 and 10'.

Figure 3:
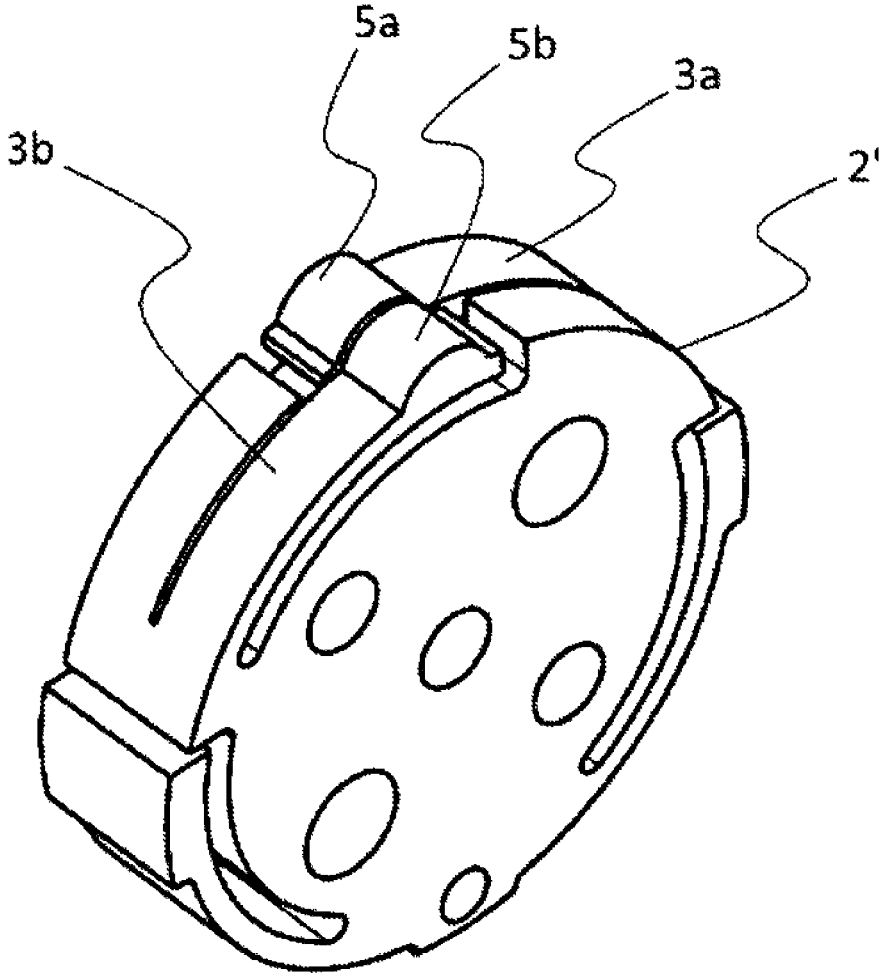
FIG. 3 a perspective plan view of an alternative embodiment of the inner rotor of a braking/latching unit according to FIGS. 1 and 2.

FIG. 3 shows an alternative embodiment, compatible with the outer rotor 1, of an inner rotor 2' having two springs arms 3*a* and 3*b* which have latching means 5*a* and 5*b* and are arranged within the rotational plane to work in opposite directions to one other. In tests with the embodiment of the inner rotor 2 according to FIGS. 1 and 2, it has been shown that, with the pre-tension required for a sufficiently stable form- and force-locking fit in the latching recesses 7, 7' and 7", the spring arm 3" also exerts a certain friction moment on the running surface 6 of the outer rotor 1 via the latching means 5. This friction moment is greater in the direction of rotation against the setting moment of the spring arm 3" than it is in the opposite direction. As a result of this being replaced by the two spring arms 3*a* and 3*b* having latching means 5*a* and 5*b* which are arranged within the rotational plane to work in opposite directions to each other, the total driving moment exerted via the two latching means 5*a* and 5*b* is the same in both directions of rotation and ensures an absolute uniformity of the braking action exerted in both directions of rotation. Since the two latching means 5*a* and 5*b* are moreover arranged in a common radial portion and cooperate synchronously with the latching recesses 7, 7' and 7" in each case, in this embodiment of the inner rotor 2' an identical breakaway moment in both directions of rotation is moreover ensured without additional latching recesses having to be provided in the running surface 6.

Figure 4:
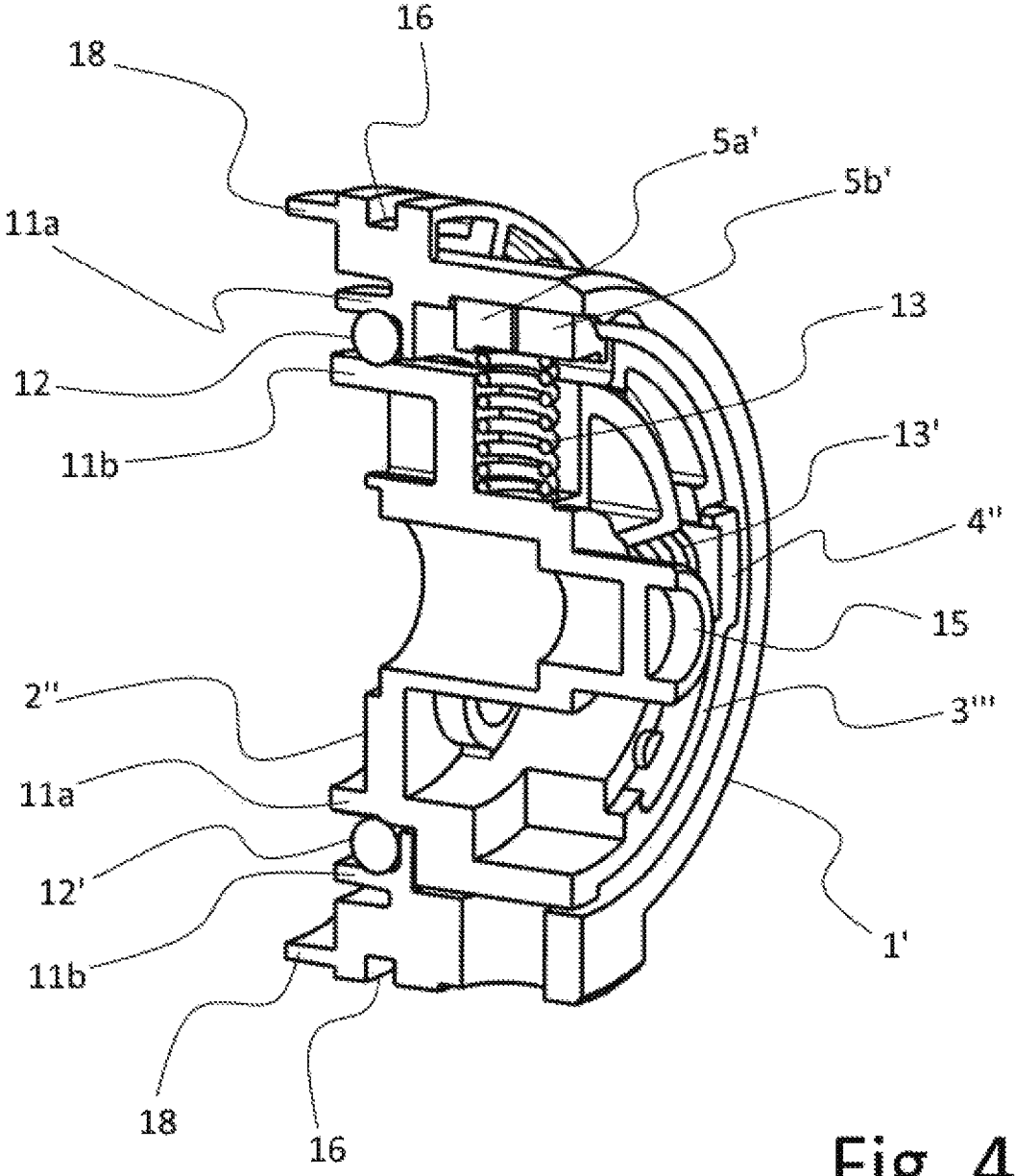
FIG. 4 a perspective sectional view of a further embodiment of the braking/latching unit.
Figure 5:
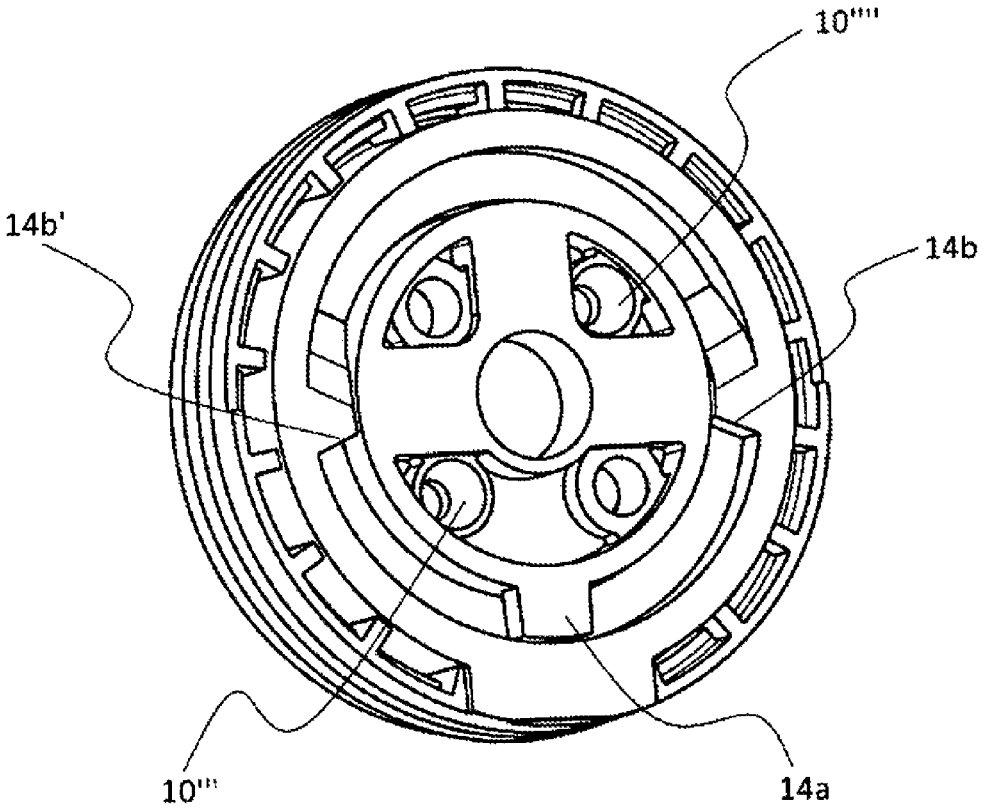
FIG. 5 a perspective front view of the assembled braking/latching unit according to FIG. 4.

FIGS. 4 and 5 show an alternative embodiment of the braking/latching unit. The outer rotor 1' and the inner rotor 2" are constructed with an integrated ball bearing and form, with the channel elements 11*a* and 11*b*, a common circumferential running channel for balls arranged therein, of which the balls 12 and 12' shown in section can be seen in the sectional illustration according to FIG. 4. Since the bearing is constructed as a full-complement ball bearing, a separate ball cage is not required. The running channel is sufficiently deep to also enable all axial forces to be absorbed. It is thereby ensured that an actuating lever (not illustrated in FIGS. 4 and 5) which is connected to the end-face bores 10''' and 10'''' of the inner rotor 2' is guided without backlash in the axial and radial direction and no perceptible additional friction moment is generated by bearing friction. All of the spring arms having braking and latching means, of which only the spring arm 3''' can be see in the sectional illustration according to FIG. 4, are constructed to be pressure-spring-loaded in this embodiment. To this end, pressure springs are arranged in each case below the spring arms in the inner rotor 2". In the sectional illustration according to FIG. 4, only the pressure spring 13 arranged below the latching means 5*a*' and 5*b*', and part of the pressure spring 13' arranged below the braking means 4" are shown here. To limit the degree of freedom of the inner rotor 2 and therefore also to limit the pivot travel of an actuating lever (not illustrated in FIGS. 4 and 5) which is connected to the end-face bores 10''' and 10'''' of the inner rotor 2", the inner rotor 2" and the outer rotor 1' are designed with a stop delimitation at the end face. A stop element 14*a* connected to the inner rotor 2" at the end face is guided between two stop elements 14*b* and 14*b*' connected to the outer rotor 1' at the end face, whereby the degree of freedom of the rotational movement of the inner rotor 2' is limited to a total of 140°. The inner rotor 2" is moreover provided with a recess 15 at its end face for receiving a sensor magnet (not illustrated in FIGS. 4 and 5). In cooperation with a corresponding Hall sensor (likewise not illustrated in FIGS. 4 and 5), which is arranged perpendicularly to the axis of rotation of the braking/latching unit at a spacing of 0.5 to 2 mm in front of the sensor magnet, this enables contactless detection of the angular position of the inner rotor 2" and therefore also an actuating lever connected thereto. To seal the device interior of the braking/latching unit with respect to the environment, the outer rotor 1' has a circumferential sealing groove 16 for receiving an O-ring (not illustrated). Sealing with respect to the actuating lever takes place via a lip seal. A protective ring 16 protects the running surface of the sealing lip 17 from being directly acted upon by spray or splash water.

LIST OF REFERENCE SIGNS

1, 1' Outer rotor
2, 2', 2" Inner rotor
3, 3', 3", 3''', 3*a*, 3*b* Spring arms
4, 4', 4" Braking means
5, 5*a*, 5*b*, 5*a*' 5*b*' Latching means
6 Running surface
7, 7', 7" Latching recess
8 Guide means
9 Threaded bore
10, 10', 10", 10''' Bore
11*a*, 11*b* Channel element
12, 12' Ball
13, 13' Pressure spring
14*a*, 14*b* Stop elements
15 Recess
16 Sealing groove
17 Sealing lip
18 Protective ring

The invention claimed is:

1. A braking/latching unit for command issuers, comprising:

two rotor elements including an outer rotor having a circular opening forming a bearing ring and an inner rotor arranged in the opening, which are arranged to be rotationally movable relative to one another, wherein one of the two rotor elements is statically fixed in its position and the other of the two rotor elements is either formed with a manually operable actuating element or is designed to be connectable to such, wherein the inner rotor is formed with at least three spring arms which are arranged radially in a circumferential direction, are connected at one side to said inner rotor and may each be pressed into a recess located in a lateral surface of the inner rotor, wherein at least one of the spring arms is formed with a latching means at its free end, which cooperates with releasable form and force locking with at least one corresponding latching recess in a running surface of the bearing ring, wherein at least two of the spring arms are arranged in each case in pairs within a rotational plane to work in opposite directions to each other and are each formed with a braking means at their free ends, and wherein the spring arms each act with radial force locking on the running surface of the bearing ring via the braking and latching means.

2. The braking/latching unit as claimed in claim 1, wherein the inner rotor is formed with at least four spring arms, and wherein at least two of the spring arms are provided with the latching means and are arranged in each case in pairs within the rotational plane to work in opposite directions to each other.

3. The braking/latching unit as claimed in claim 2, wherein the latching means of a spring arm pair in each case are arranged in a common radial portion and cooperate in each case synchronously with the at least one latching recess(es).

4. The braking/latching unit as claimed in claim 1, wherein the spring arms having the braking means and/or the spring arms having the latching means are designed to be pressure-spring-loaded with pressure springs, and wherein the pressure springs are arranged in the inner rotor and act radially on the spring arms.

5. The braking/latching unit as claimed in claim 1, wherein the spring arms, the latching means and the braking means are constructed with the inner rotor as a single-part component.

6. The braking/latching unit as claimed in claim 5, wherein the inner and the outer rotor are constructed as plastics injection-molded parts.

7. The braking/latching unit as claimed in claim 1, wherein the two rotor elements are constructed with a common ball bearing.

8. The braking/latching unit as claimed in claim 1, wherein the rotor two elements are each formed with a stop delimitation.

9. The braking/latching unit as claimed claim 1, wherein the rotationally movable rotor element is formed with a sensor magnet.

* * * * *